US007338580B2

(12) United States Patent
Conta et al.

(10) Patent No.: US 7,338,580 B2
(45) Date of Patent: Mar. 4, 2008

(54) MONOLITHIC PRINTHEAD WITH MULTIPLE INK FEEDER CHANNELS AND RELATIVE MANUFACTURING PROCESS

(75) Inventors: Renato Conta, Ivrea (IT); Alessandro Scardovi, Ivrea (IT)

(73) Assignee: Telecom Italia S.p.A., Milan (IT)

( * ) Notice: Subject to any disclaimer, the term of this patent is extended or adjusted under 35 U.S.C. 154(b) by 470 days.

(21) Appl. No.: 10/924,818

(22) Filed: Aug. 25, 2004

(65) Prior Publication Data

US 2005/0024444 A1 Feb. 3, 2005

Related U.S. Application Data

(62) Division of application No. 10/257,261, filed as application No. PCT/IT01/00170 on Apr. 3, 2001.

(51) Int. Cl.
*C25D 17/00* (2006.01)

(52) U.S. Cl. ..... 204/224 M; 347/65; 216/27

(58) Field of Classification Search ..... 347/65; 216/27, 41; 204/224 M
See application file for complete search history.

(56) References Cited

U.S. PATENT DOCUMENTS 4,894,664 A 1/1990 Tsung Pan
5,322,594 A * 6/1994 Bol ..... 216/27
5,682,188 A 10/1997 Meyer et al.
5,686,224 A * 11/1997 O'Neill ..... 430/320
6,022,482 A * 2/2000 Chen et al. ..... 216/27
6,543,884 B1 * 4/2003 Kawamura et al. ..... 347/65
6,949,201 B2 * 9/2005 Conta et al. ..... 216/27

FOREIGN PATENT DOCUMENTS

EP 0 895 866 A2 7/1998
EP 0 924 077 A2 6/1999
WO WO 01/03934 A1 1/2001

* cited by examiner

*Primary Examiner*—Nam Nguyen
*Assistant Examiner*—Luan V. Van
(74) *Attorney, Agent, or Firm*—Venable LLP; Robert Kinberg; Steven J. Schwarz

(57) ABSTRACT

A thermal ink jet printhead (40) for the emission of drops of ink on a print medium (46) comprises a tank (103) containing ink (142), a lamina (67), a groove (45) and a plurality of ejectors (73), each of which comprises in turn a chamber (74) placed laterally with respect to the groove (45), and fluidly connected thereto by means of a plurality of elementary ducts (75) produced on said lamina (67).

5 Claims, 10 Drawing Sheets

MONOLITHIC PRINTHEAD WITH MULTIPLE INK FEEDER CHANNELS AND RELATIVE MANUFACTURING PROCESS

This is a Divisional Application of U.S. patent application Ser. No. 10/257,261 filed Oct. 10, 2002 which is a U.S. National Phase Application Under 35 U.S.C. §371 and applicants herewith claim the benefit of priority of PCT/IT01/00170 filed Apr. 3, 2001, which was published Under PCT Article 21(2) in English and Application No. T02000A000335 filed in Italy on Apr. 10, 2000, the noted applications are incorporated by reference herein.

TECHNICAL FIELD

This invention relates to a printhead used in equipment for forming, through successive scanning operations, black and colour images on a print medium, usually though not exclusively a sheet of paper, by means of the thermal type ink jet technology, and in particular to the head actuating assembly, and the relative manufacturing process.

BACKGROUND ART

Depicted in FIG. 1 is an ink jet colour printer on which the main parts are labelled as follows: a fixed structure 41, a scanning carriage 42, an encoder 44 and printheads 40 which may be either monochromatic or colour, and variable in number.

The printer may be a stand-alone product, or be part of a photocopier, of a plotter, of a facsimile machine, of a machine for the reproduction of photographs and the like. The printing is effected on a physical medium 46, normally consisting of a sheet of paper, or a sheet of plastic, fabric or similar.

Also shown in FIG. 1 are the axes of reference:

x axis: horizontal, i.e. parallel to the scanning direction of the carriage 42; y axis: vertical, i.e. parallel to the direction of motion of the medium 46 during the line feed function; z axis: perpendicular to the x and y axes, i.e. substantially parallel to the direction of emission of the droplets of ink.

FIG. 2 shows an axonometric view of the printhead 40, on which are indicated nozzles 56, generally arranged in two columns parallel to the y axis, and a nozzle plate 106.

The composition and general mode of operation of a printhead according to the thermal type technology, and of the "top-shooter" type in particular, i.e. those that emit the ink droplets in a direction perpendicular to the actuating assembly, are already widely known in the sector art, and will not therefore be discussed in detail herein, this description instead dwelling more fully on only those features of the heads and the head manufacturing process of relevance for the purposes of understanding this invention.

FIG. 3 depicts a section parallel to the plane z-x of a head 40, which shows an ejector 55 corresponding to one of the nozzles 56. The following can be seen labelled: a tank 103 containing ink 142, a slot 102, a duct 53 of length G, a chamber 57, a resistor 27, a droplet 51 of ink, a bubble 65 of vapour, a meniscus 54 local to the surface of separation between ink and air, an external edge 66 and arrows 52 indicating the prevalent direction of motion of the ink.

FIG. 4 shows an enlarged axonometric view of two chambers 57, adjacent to and communicating with the slot 102 through the ducts 53, which generally are of rectangular section with depth h and width c.

The current technological trend in ink jet printheads is to produce a large number of nozzles per head (≧300), a definition of more than 600 dpi (dpi=dots per inch), a high working frequency (≧10 kHz) and smaller droplets (≦10 pl) than those produced in earlier technologies.

Requirements such as these are especially important in colour printhead manufacture and make it necessary to produce actuators and hydraulic circuits of increasingly smaller dimensions, greater levels of precision, and strict assembly tolerances.

These drawbacks are solved, for instance, by means of the monolithic printhead described in the Italian patent application TO 99A 000610, a section of which is illustrated in FIG. 5. A lamina 64, having width J and consisting of numerous layers, comprises the resistor 27 which, when a current passes through it, produces the heat needed to form the vapour bubble 65 which, by expanding rapidly inside the chamber 57, results in emission of the droplet of ink 51 through the nozzle 56. The lamina 64 is of a thickness generally between 1 and 50 mμ, and is subject to vibration on account of the sudden formation and subsequent collapse of the vapour bubble 65.

In the patents U.S. Pat. No. 6,000,787 and EP 0 936 070, heads are described the chambers of which are produced laterally with respect to the grooves: as a result, the resistors are adherent to a body of Silicon having a much greater thickness than that of the lamina and therefore exempt from the above-mentioned vibrations. However the solutions described in the patents quoted do not solve the problem described below.

It is in fact important to ensure that the volume and speed of the droplets successively emitted are as constant as possible, and that no "satellite" droplets are formed as these, with a trajectory generally different from the main droplets, are distributed randomly near the edges of the graphic symbols, reducing their sharpness.

This problem is solved, for instance, by means of the head with multiple ink feeder channels described in the Italian patent application AO 99A 0002. FIG. 6 illustrates an ejector 55' of this printhead, comprising the slot 102, the chamber 57, the resistor 27 and elementary ducts 72, which convey the ink 142 from the slot 102 to the chamber 57, each of which having depth a, width b and length g. By way of example, the figure shows three elementary ducts 72, but their number N could be different from this.

The patent quoted above discloses the details of a method for calculating the width b and the number N which permit to render minimal the time constant τ of the column of ink that fills the ejector 55' and at the same time to render critical the damping of the oscillations of the meniscus 54 following emission of the droplet 51, for the purposes of obtaining a high emission frequency of the droplets, of ensuring that their volume and speed are as constant as possible, and of avoiding the formation of satellite droplets. This head, however, is not monolithic.

A further problem found in thermal ink jet printheads will now be illustrated. If various ejectors are driven simultaneously, to print for instance a vertical line, some of the tracks belonging to the microelectronics are passed through by the sum of the driving currents. This sum varies in function of the number of ejectors activated on each occasion, and in turn produces a variable voltage drop.

It is preferable to command the ejectors at different times, so that only the current needed for a single ejector passes through the tracks each time and the voltage drops on each are therefore small and constant. In addition, it is necessary for any two ejectors that are immediately successive in the time sequence of commands not to be adjacent, the purpose being to avoid the phenomenon of intermodulation, known to those acquainted with the sector art.

For these reasons, the ejectors belonging to each column parallel to the y axis are staggered progressively by an interval parallel to the x axis. Compensation for the mechanical stagger is provided by a corresponding time delay in the commands, with the purpose of obtaining the desired figure from printing.

On account of the mechanical stagger, the length G of the duct 53, or the length g of the elementary ducts 72, are different for the different ejectors, with a consequent variation in the time constant $\tau$ and in criticality, among the ejectors, of the damping of the oscillations of the meniscus 54.

DISCLOSURE OF INVENTION

The object of this invention is that of producing a monolithic head in which the width of the lamina is the lowest possible, so that mechanical robustness of the lamina is maximal.

A further object is that of producing a monolithic head in which the lamina is not subjected to vibrations caused by the sudden formation and successive collapse of the vapour bubble.

Yet another object is that of rendering the emission frequency of the droplets of ink maximal by producing a time constant $\tau$ of the ejector that is as short as possible, while simultaneously satisfying the critical damping condition of the meniscus.

A further object is that of producing the time constant $\tau$ and the critical damping condition of the meniscus with high precision.

Another object is that of rendering the time constant $\tau$ and critical damping condition of the meniscus dependent solely upon the dimensions of the elementary ducts, and therefore insensitive to the mechanical tolerances with which the other parts of the ejector are made.

Yet another object is that of increasing the degrees of freedom of design of the ejector, disposing of the additional parameter that is the number of elementary ducts in parallel.

Another object is that of staggering the positions of the successive ejectors of a column without altering either the time constant $\tau$ or the criticality of the damping of the oscillations of the meniscus of the different ejectors.

Another object is that of filtering out any impurities in the ink.

These and other objects, characteristics and advantages of the invention will be apparent from the description that follows of a preferred embodiment, provided purely by way of an illustrative, non-restrictive example, and with reference to the accompanying drawings.

BEST MODE FOR CARRYING OUT THE INVENTION

Figure 1:
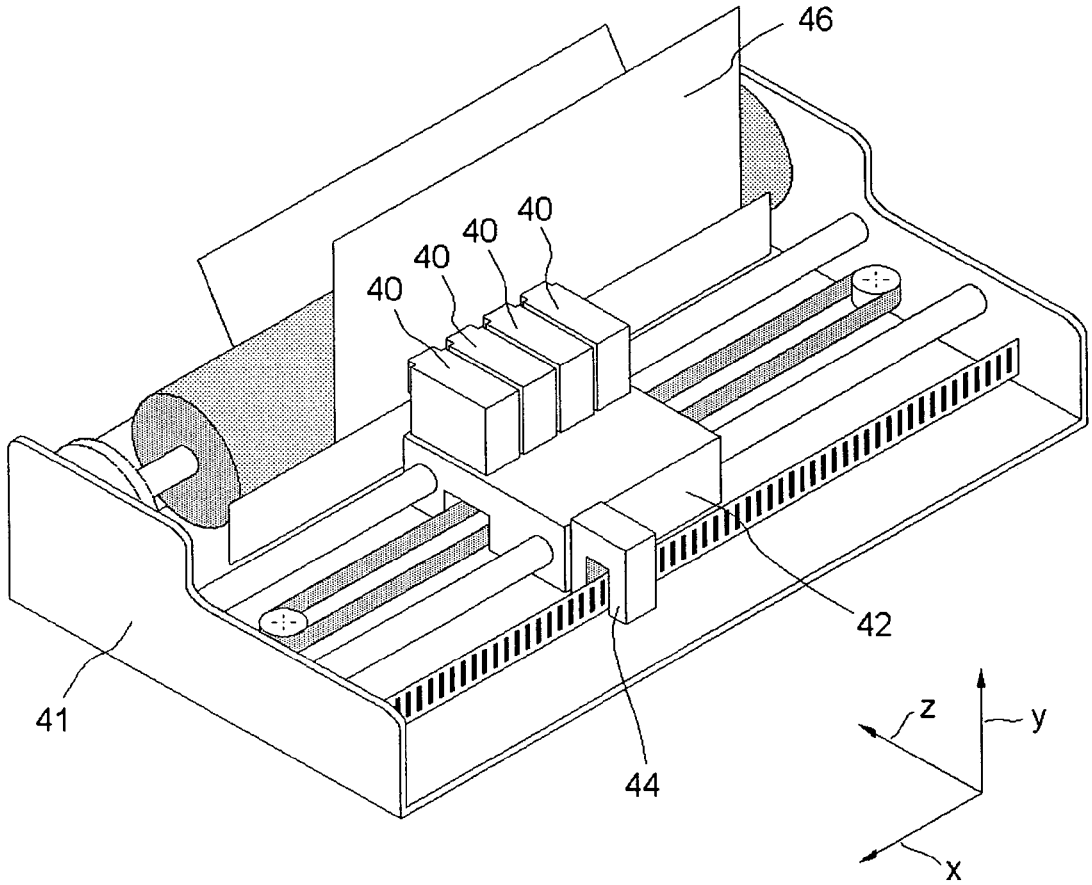
FIG. 1—represents an axonometric projection of an inkjet printer.
Figure 2:
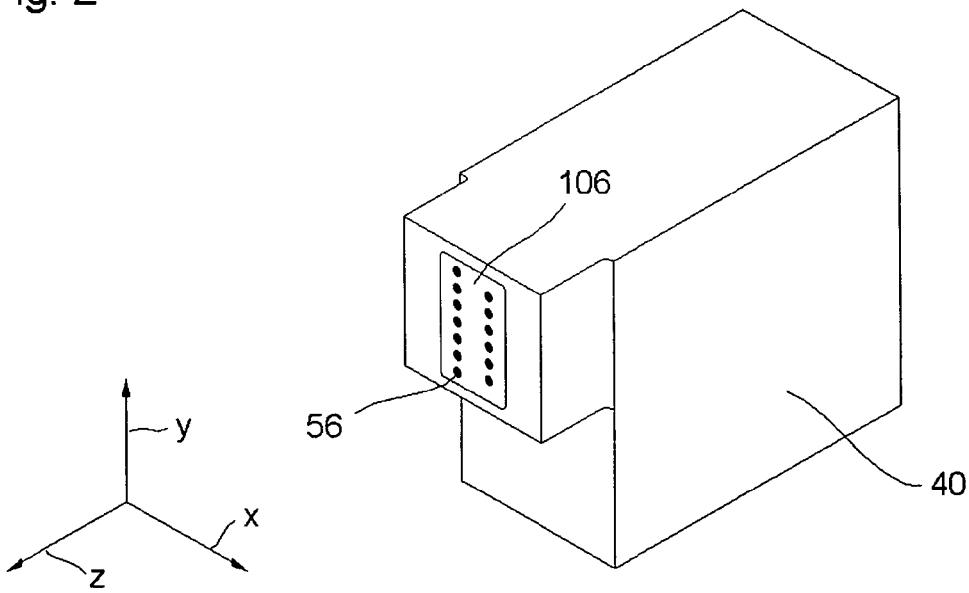
FIG. 2—represents an axonometric projection of an inkjet printhead.
Figure 3:
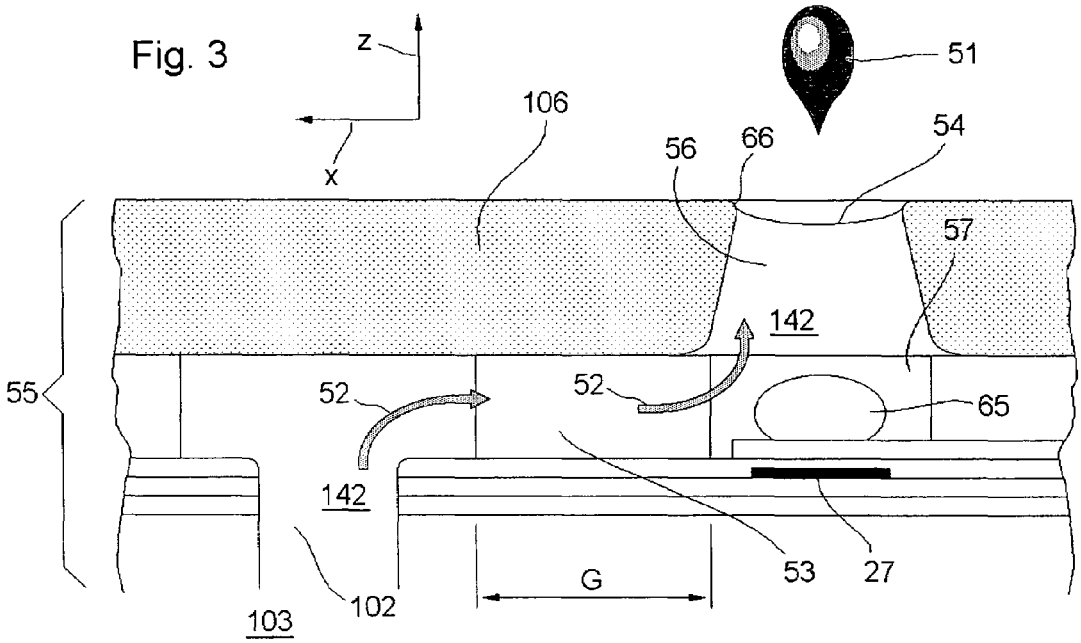
FIG. 3—represents a section view of an ejector of the head, according to the known art.
Figure 4:
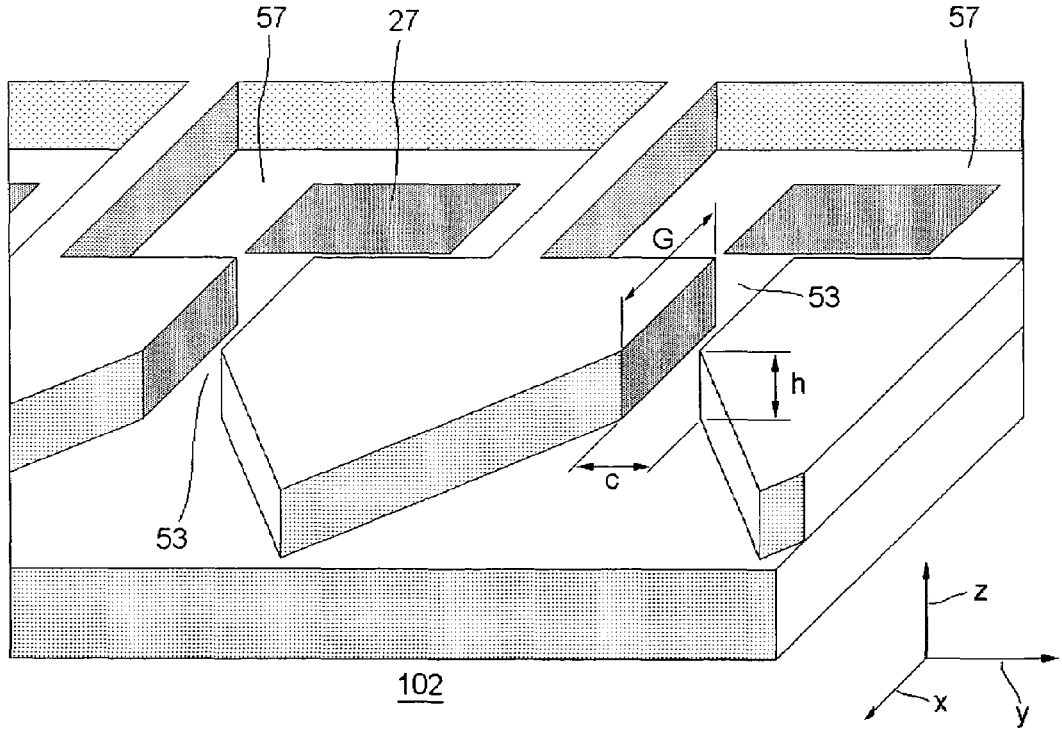
FIG. 4—represents an axonometric view of two ejection chambers, according to the known art.
Figure 5:
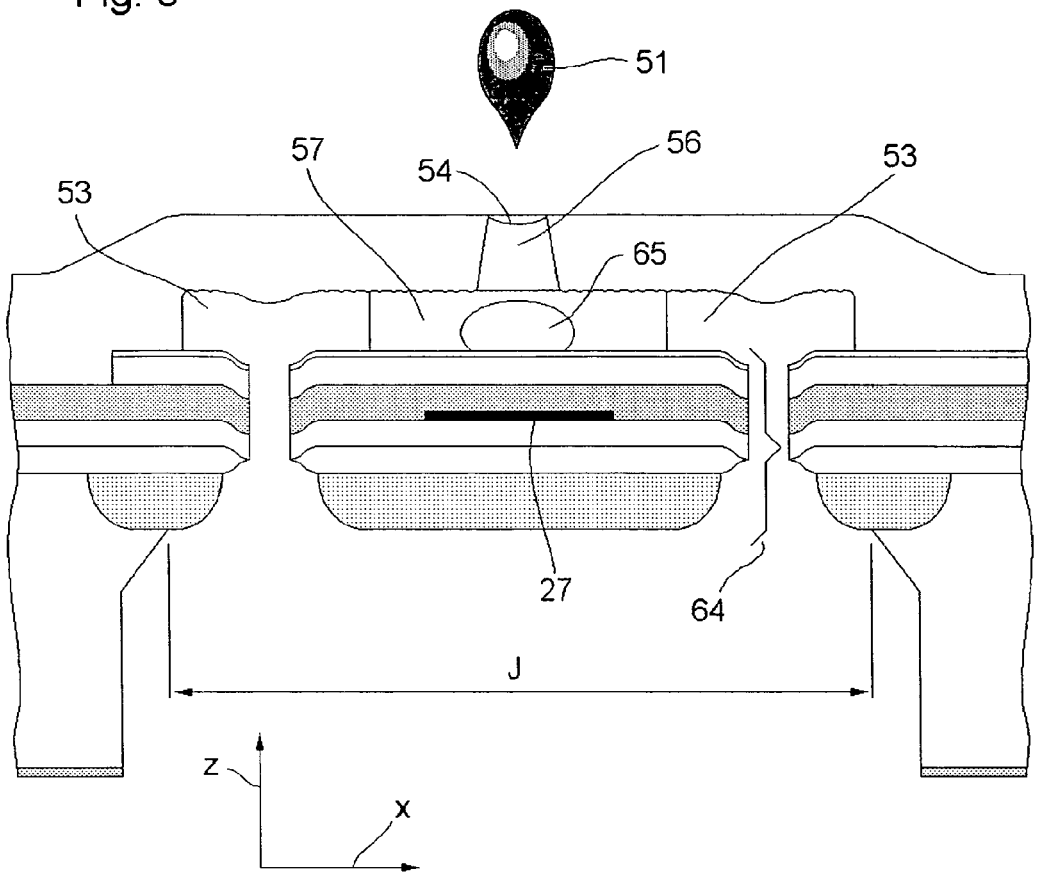
FIG. 5—represents a section view of an ejector of a monolithic head, according to the known art.
Figure 6:
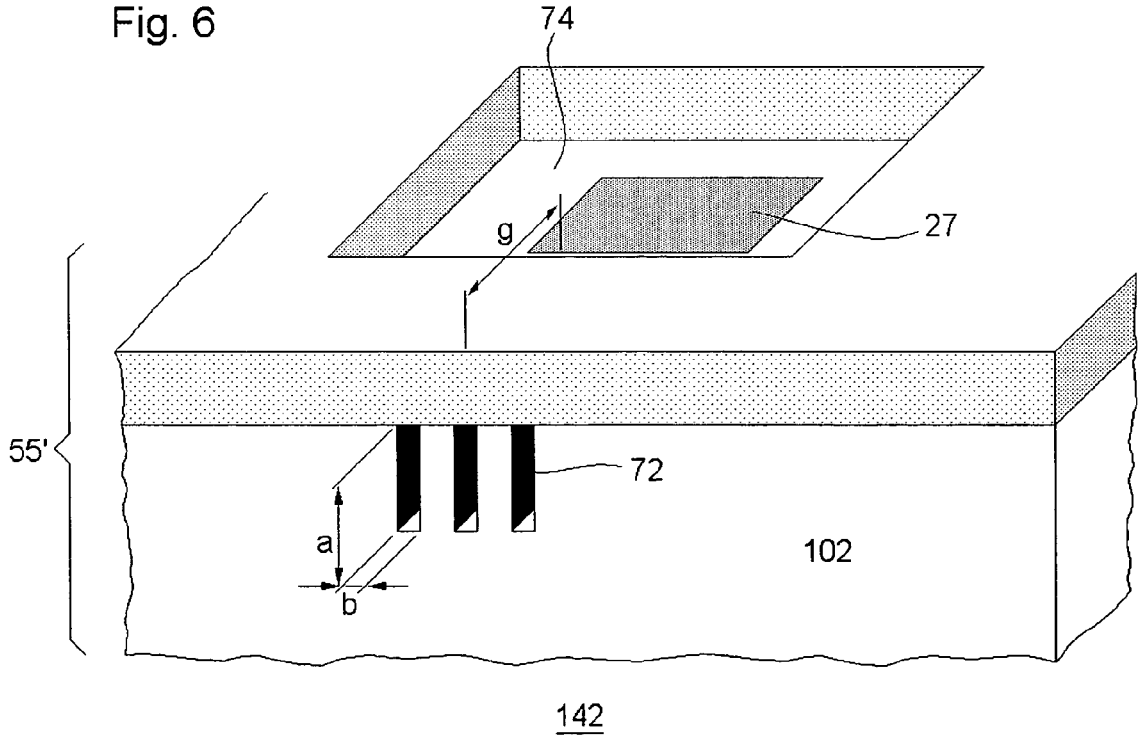
FIG. 6—represents an axonometric view of a multiple channel head, according to the known art.
Figure 7:
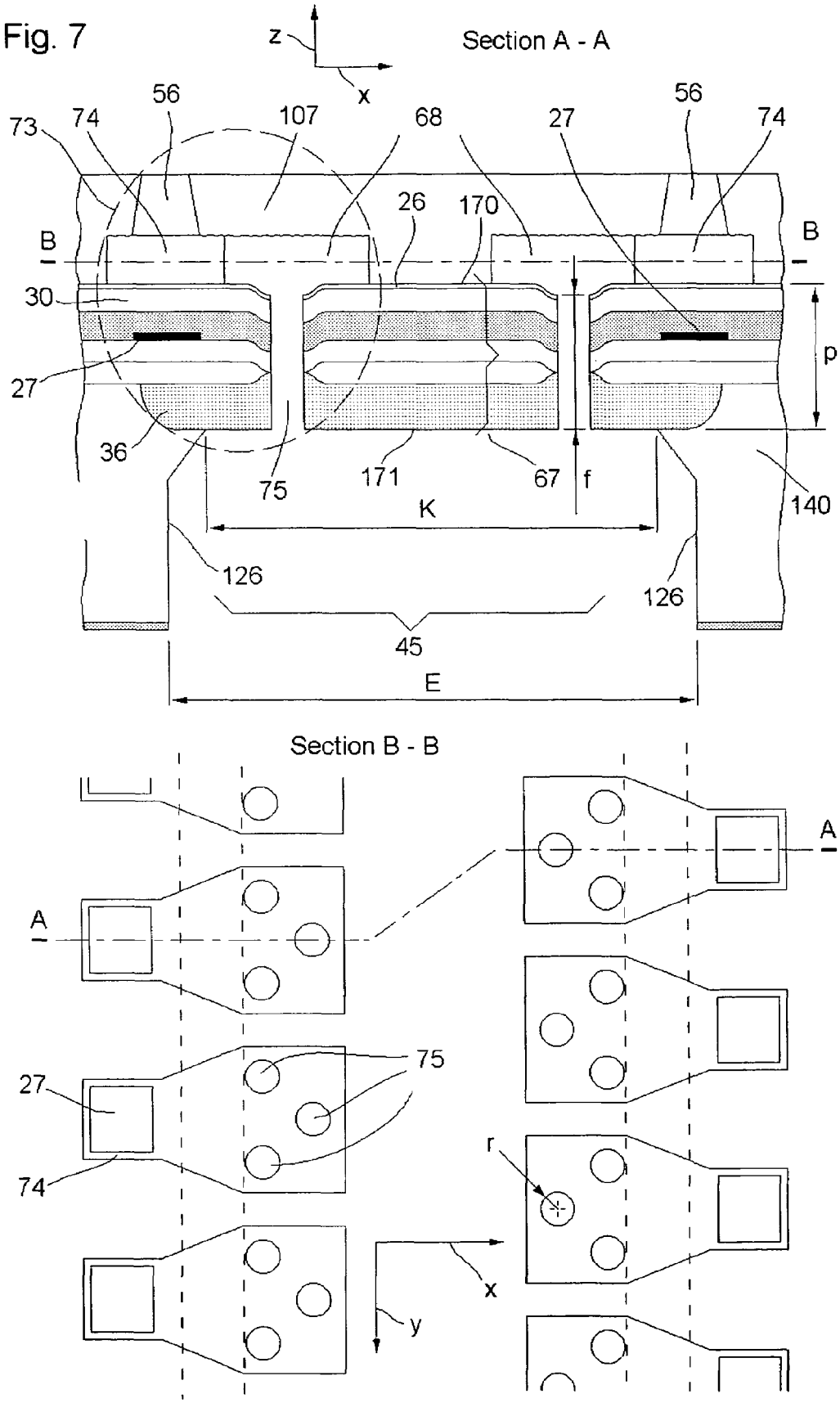
FIG. 7—represents a section along a plane AA and a section along a plane BB of some ejectors, according to this invention.

FIG. 7 represents a section along a plane AA and a section along a plane BB of some ejectors, according to this invention. For simplicity's sake, the other parts of the head are not depicted as they are already known and do not concern the invention. The following are labelled in the figure:

- a substrate 140 of Silicon p;
- a structural layer 107, according to the invention, of a thickness preferably between 15 and 60 μm and comprising negative photoresists, of the polyamide or epoxy type or of epoxy resin;
- a chamber 74 according to the invention, produced in the structural layer 107;
- the resistor 27 on the bottom of the chamber 74;
- a groove 45 having two parallel walls 126 and width E;
- a lamina 67 of width K and thickness p, which has an upper face 170 and a lower face 171;
- an N-well layer 36;
- a conducting layer 26 made, as a non-restrictive example, from a layer of Tantalum of thickness preferably between 0.4 and 0.6 μm, covered by a layer of Gold of thickness preferably between 100 and 500 Å;
- a protection layer 30, made for instance of $Si_3N_4$ and SiC; and
- elementary ducts 75 according to the invention, which convey the ink 142 from the groove 45 to the chamber 74. Each chamber 74 comprises N elementary ducts 75, which can have sections of any shape, including different shapes either inside each chamber 74, or among the different chambers 74.

In the non-restrictive example of FIG. 7, each chamber comprises three elementary ducts 75, each of length f and circular section of radius r.

The whole comprising a chamber 74, a nozzle 56, a resistor 27 and the elementary ducts 75 is called an ejector 73.

The new lamina 67 no longer contains the resistor 27 and is therefore of lesser width K with respect to the width J of the lamina 64 of the known art: this gives it greater mechanical robustness. Also traced in the section B-B are two vertical dashed lines which represent the minimum and maximum value that the width K of the lamina 67 can have due to its manufacturing tolerances. By way of a non-restrictive example, the lamina 67 has a width K of between 100 and 200 μm and a thickness p of between 1 and 50 μm, and preferably between 3 and 10 μm. The resistor 27, always external to the lamina 67, adheres to a body of Silicon exempt from vibrations.

To describe the operation of an ejector 73 of this head, an electrical analogy is used in which the following equivalencies are established:

| | |
|---|---|
| V = electrical voltage in volts | equivalent to: pressure in $N/m^2$; |
| I = current in A | equivalent to: flow rate in $m^3/s$; |
| R = resistance in ohm | equivalent to: hydraulic resistance in $N/m^2/m^3/s = N\ s/m^5$; |
| L = Inductance in henry | equivalent to: hydraulic inertance in $kg/m^4$; |
| C = capacitance in farad | equivalent to: hydraulic compliance in $m^3/N/m^2 = m^5/N$. |

Figure 8:
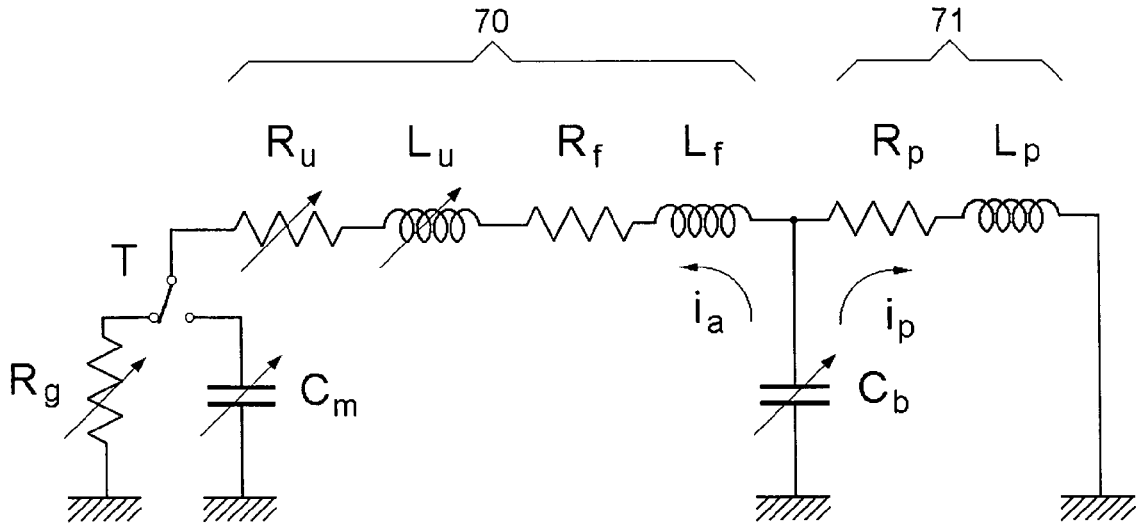
FIG. 8—represent an equivalent electric diagram of the hydraulic circuit of an ejector of the head.

In the equivalent diagram of FIG. 8, the bubble 65 corresponds to a variable capacitance $C_b$. There is a front leg 70, equivalent to the whole formed by the chamber 74, the nozzle 56, the meniscus 54 and the droplet 51, and a rear leg 71, which represents the section of the hydraulic circuit between the chamber 74 and the groove 45.

The front leg 70 comprises a fixed impedance $L_f$, $R_f$ corresponding substantially to the chamber 74, a variable impedance $L_u$, $R_u$, corresponding substantially to the nozzle 56, and a switch ⇆ which, during the phase in which the droplet 51 is formed, introduces a variable resistance $R_g$ corresponding substantially to the droplet itself, whereas, during the phases of withdrawal of the meniscus 54, of filling of the nozzle, of subsequent oscillation and damping of the meniscus, it introduces a capacitance $C_m$ corresponding substantially to the meniscus itself.

Ejection of the ink takes place in accordance with the following phases:

a) An electronic control circuit supplies energy to the resistor 27, so as to produce local boiling of the ink with formation of the bubble 65 of vapour in expansion. During this phase, in the equivalent electric circuit of FIG. 8, the variable resistance $R_g$ is introduced. The bubble 65 generates two opposing flows: $I_p$ (towards the groove 45) and $I_a$ (towards the nozzle 56).

b) The electronic circuit completes the delivery of energy to the resistor 27, the vapour condenses, the bubble 65 collapses, the droplet 51 detaches itself, the meniscus 54 withdraws emptying the nozzle 56. There remain the two opposing flows $I_p$ and $I_a$. In this phase, in the equivalent circuit of FIG. 8, the capacitance $C_m$ corresponding to the meniscus 54, is introduced.

c) The bubble 65 has disappeared, the meniscus 54 demonstrates its capillarity and goes back towards the outer edge 66 of the nozzle 56 sucking new ink 142 into the nozzle 56. Its return completed, the meniscus 54 remains attached to the outer edge 66 oscillating like a vibrating membrane. In the equivalent circuit of FIG. 8, the capacitance $C_m$ is still introduced. During this phase, the equivalent circuit of the ejector 55 is simplified as sketched in FIG. 9, where $C_m$ represents the capacitance of the meniscus, while R and L represent respectively the sum of all the resistances and of all the inductances present between the meniscus 54 and the groove 45. In addition the flows $I_p$ and $I_a$ converge into a single flow i.

To obtain optimal operation of the ejector 55, it is necessary for the meniscus 54, at the end of the step c), to reach the idle state rapidly without oscillating. In this way, the ink 142 does not wet the outer surface of the nozzle plate 106, thereby avoiding alterations of speed and volume of the successive droplets.

For a given nozzle 56, the parameters $L_u$, $R_u$ and $C_m$ belonging to the front hydraulic part 70 of the ejector 55 are set and therefore the values of R and L according to the criteria set down below can only be obtained by acting on design of the rear hydraulic part 71.

Figure 9:
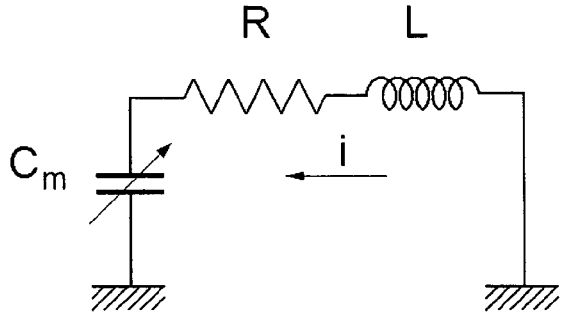
FIG. 9—represents a simplified equivalent electric diagram of the hydraulic circuit of an ejector of the head.

The expression in function of the time of i, which represents the flow, is given by the known relation:

$$i = \frac{V_m}{L} * t * e^{\frac{-t}{2\tau}} \tag{1}$$

where $V_m$ represents the pressure generated by the meniscus 54, which is negative during the filling phase, and τ is the time constant measured in seconds of the RLC circuit of FIG. 9, equal to the ratio L/R.

To obtain maximum speed in filling of the nozzle 56, the flow I must be rendered maximal, and for this to happen, L and τ must be rendered minimal.

Also, for the meniscus 54 to reach the idle state rapidly without oscillating, the equivalent circuit of FIG. 9 must be "critical damping" type, and must to this end satisfy the known relation:

$$R = 2 * \sqrt{\frac{L}{C_m}} \tag{2}$$

For an elementary duct 75 having a circular section of radius r and length l, the following known relations apply:

$$R \cong \frac{8 * \rho * \upsilon * f}{r^4} \tag{3}$$

$$L \cong \frac{\rho * f}{r^2} \tag{4}$$

$$\tau = \frac{L}{R} = \frac{r^2}{8 * \upsilon} \tag{5}$$

where ρ is the density of the ink in $kg/m^3$, v the viscosity of the ink in $m^2/s$, and all lengths are measured in metres.

The time constant τ is a function of the radius r, while it is independent of the length f.

It is possible to determine a value of r which gives values R and L such as to produce critical damping, according to the expression (2). However the same value of r, substituted in (5), gives a value of τ which limits the flow i, according to the relation (1), and accordingly also limits the emission frequency of the droplets. Moreover, it is not possible to modify the length f at will, as this depends on the thickness p of the lamina 67, which is subject to other technological and functional constraints.

To increase the emission frequency of the droplets, it is necessary to render the time constant τ extremely short, while at the same time satisfying the critical damping condition: this problem is solved in this invention by producing, for each chamber 74, a plurality of N elementary ducts 75 in parallel. A method of procedure for calculating the correct number N will now be described.

The time constant τ is a function of the radius r of each single duct 75, while it is independent of the number N of ducts in parallel, as indicated by the relation (5). It is therefore possible to obtain the shortest possible time constant τ by selecting the smallest possible value for r, compatibly with technological feasibility: in practice, the radius r according to this invention is between, though not exclusively, 4 and 12 μm.

Having thus determined the geometrical dimensions of the single duct 75, values R' and L' are obtained for the equivalent resistance and inductance of each duct 75 using the relations (3) and (4). The total resistance R and the total inductance L of the circuit equivalent to the plurality of ducts 75 in parallel are expressed by means of the known formula for parallel impedances, and are:

$$R=R'/N \tag{6}$$

$$L=L'/N \tag{7}$$

It is now possible to obtain the value of N needed to render damping critical, by substitution of the expressions (6) and (7) in (2), which becomes:

$$\frac{R'}{N}=2*\sqrt{\frac{L'}{N*C_m}} \tag{8}$$

and which enables us to obtain $$N=(R')^2*\frac{C_m}{4L'} \tag{9}$$

The value thus obtained for N is generally not a whole number, and must be rounded to the next nearest whole number. If the damping obtained is too different from critical damping, due to the rounding, adjustments may still be made to the various parameters described, by using for instance different values for the radius of one or more elementary ducts 75.

Figure 10:
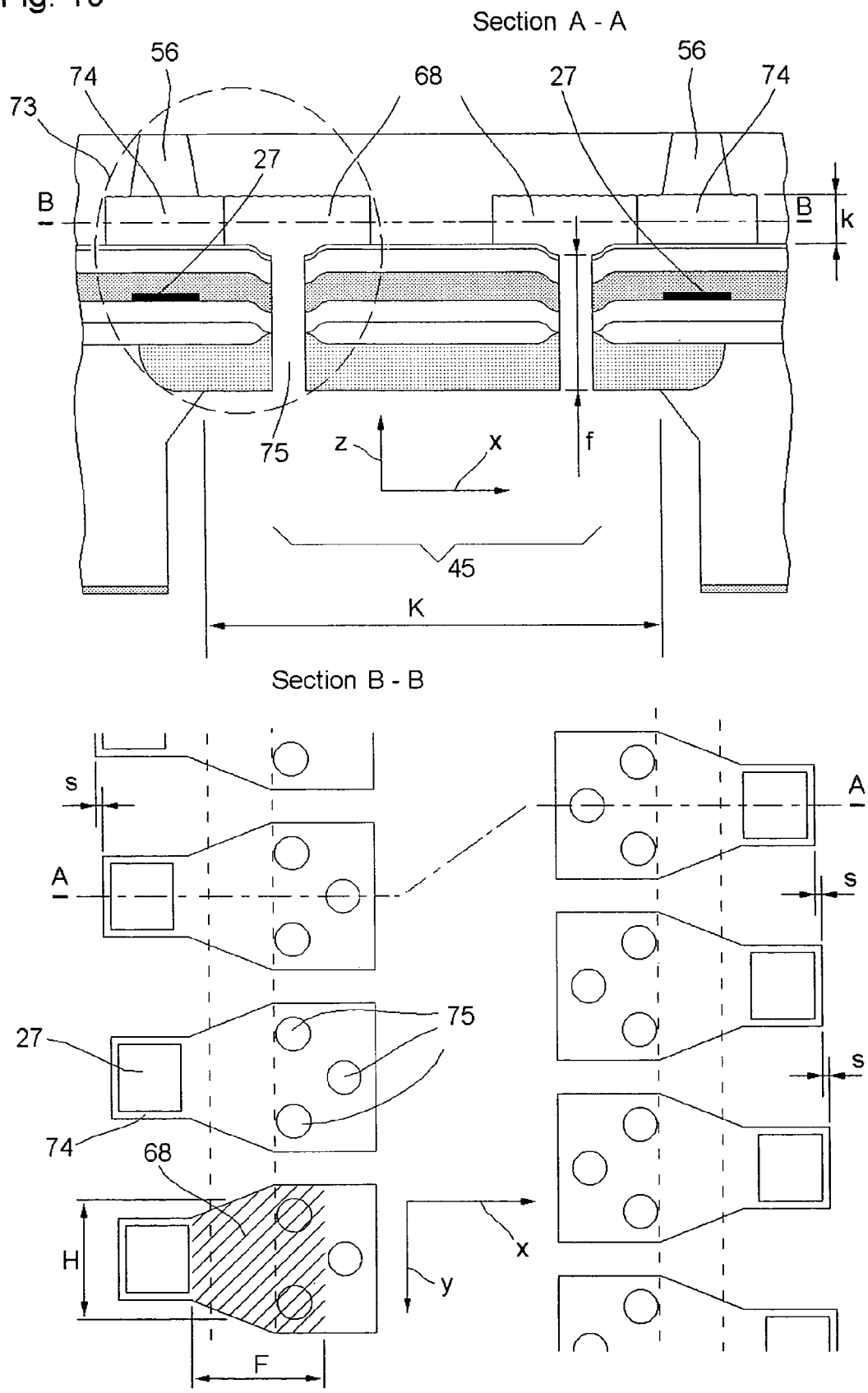
FIG. 10—represents a section along a plane AA and a section along a plane BB of some progressively staggered ejectors, according to this invention.

FIG. 10 represents a section according to a plane AA and a section according to a plane BB of some ejectors 73, according to this invention, arranged in two columns not exactly parallel to the y axis, but progressively staggered by a stagger s, parallel to the x axis, the value of which, by way of non-restrictive example, is between 1 and 2 μm. The stagger s is compensated by a corresponding time delay in the commands, so as not to alter the shape of the graphic symbols printed. In this way, when having to print a vertical line for instance, the different ejectors are driven at different times, so that the tracks belonging to the microelectronics are traversed each time by the current needed for a single ejector, and the voltage drops thereon are therefore constant. Furthermore no two ejectors, immediately successive to one another in the time sequence of commands, must be adjacent, the purpose here being to avoid intermodulation, a phenomenon known to those acquainted with the sector art.

Included in the figure is a junction channel 68, which though present in all the ejectors, is depicted with a shaded surface on only one thereof, having average length F, average width H and height k.

In the section B-B, two dashed vertical lines are also traced representing the minimum and maximum width K which it is possible for the groove 45 to have. In any case, the resistors 27 are always external to the groove 45.

On account of the stagger s, the average lengths F of the junction channels 68 are different for the different ejectors, with consequent variation of the hydraulic impedance, of the time constant τ and of criticality of the damping of the oscillations of the meniscus 54 among the different ejectors. In this invention, this problem is solved by means of the following stratagems:

first—the junction channel 68 is made with a width H as wide as possible, so that it has an impedance that is negligible with respect to that of the elementary ducts 75 and possesses sufficient space on which to produce a greater number of elementary ducts 75. There is still a difference between the hydraulic impedances of the different ejectors, which has to be compensated;

second—the difference between the hydraulic impedances of the different ejectors is compensated for. This could be done by modifying the width H, linked to the length F by the relations $$R\cong\frac{12*\rho*\upsilon*F}{k^3*H} \tag{10}$$

$$L\cong\frac{\rho*F}{k*H} \tag{11}$$

but, to keep R and L constant, the width H would be inversely proportional to F, and would therefore undergo significant variations upon variation of F.

It is more convenient to leave the width H unaltered and instead modify the radius r of the elementary ducts 75 in such a way that the total impedance is the same between the different ejectors. The relations (3) and (4) indicate that the resistance R and the inductance L depend on r respectively to the power of four and to the square, and it is therefore possible to completely compensate the effect of the variation of F with small adjustments of r. At the same time, the critical damping is maintained by means of correctly determining the number N of the ducts 75.

The values of the resistance R and of the inductance L are precise and repetitive, since the radius r is defined with great exactness using photolithographic techniques, and in addition the length f is great enough to give a well-defined and adjustable impedance, being made in the thickness of the lamina 67. The technique employed in producing the latter-named also ensures that tight tolerances are respected.

The manufacturing process of the ejectors 73 for the monolithic ink jet printhead 40 is identical to that described in detail in the above-quoted Italian patent application No. TO 99 A 000610, which is incorporated herein for reference.

Figure 11:
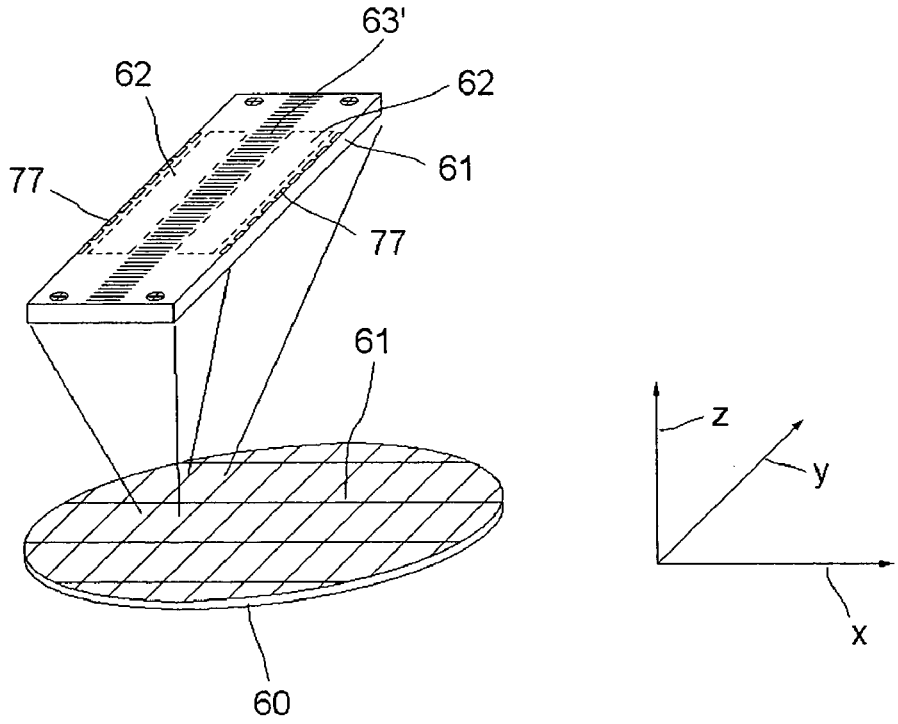
FIG. 11—represents a wafer of semiconductor material, containing dice not yet separated.

This process initially comprises the production of a wafer 60, as shown in FIG. 11, consisting of a plurality of dice 61, each of which comprises microelectronics 62, an area 63' suitable for containing microhydraulics 63 consisting of a plurality of ejectors 73, and soldering pads 77.

In a first part of the process, when all the dice 61 are still joined in the wafer 60, the microelectronics 62 are made and at the same time, taking advantage of the same process steps and the same masks, the microhydraulics of each die 61 are produced in part.

Figure 12:
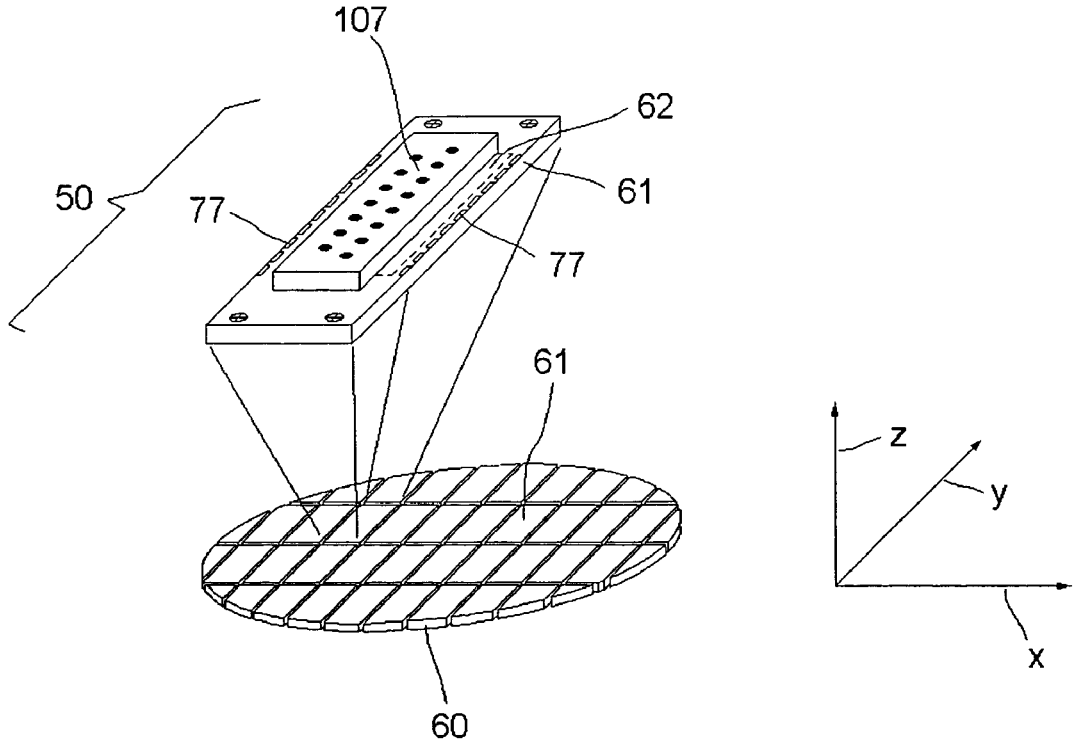
FIG. 12—represents the wafer of semiconductor material, in which the dice have been separated.

In a second part of the process, on each of the dice 61 still joined in the wafer 60, the structural layers 107 are made and the microhydraulics 63 completed by means of operations compatible with the first part of the process. At the end of the process, the dice 61 are separated by means of a diamond wheel: the whole consisting of a die 61 and a structural layer 107 thus comes to constitute an actuator 50, as may be seen in FIG. 12.

Figure 13:
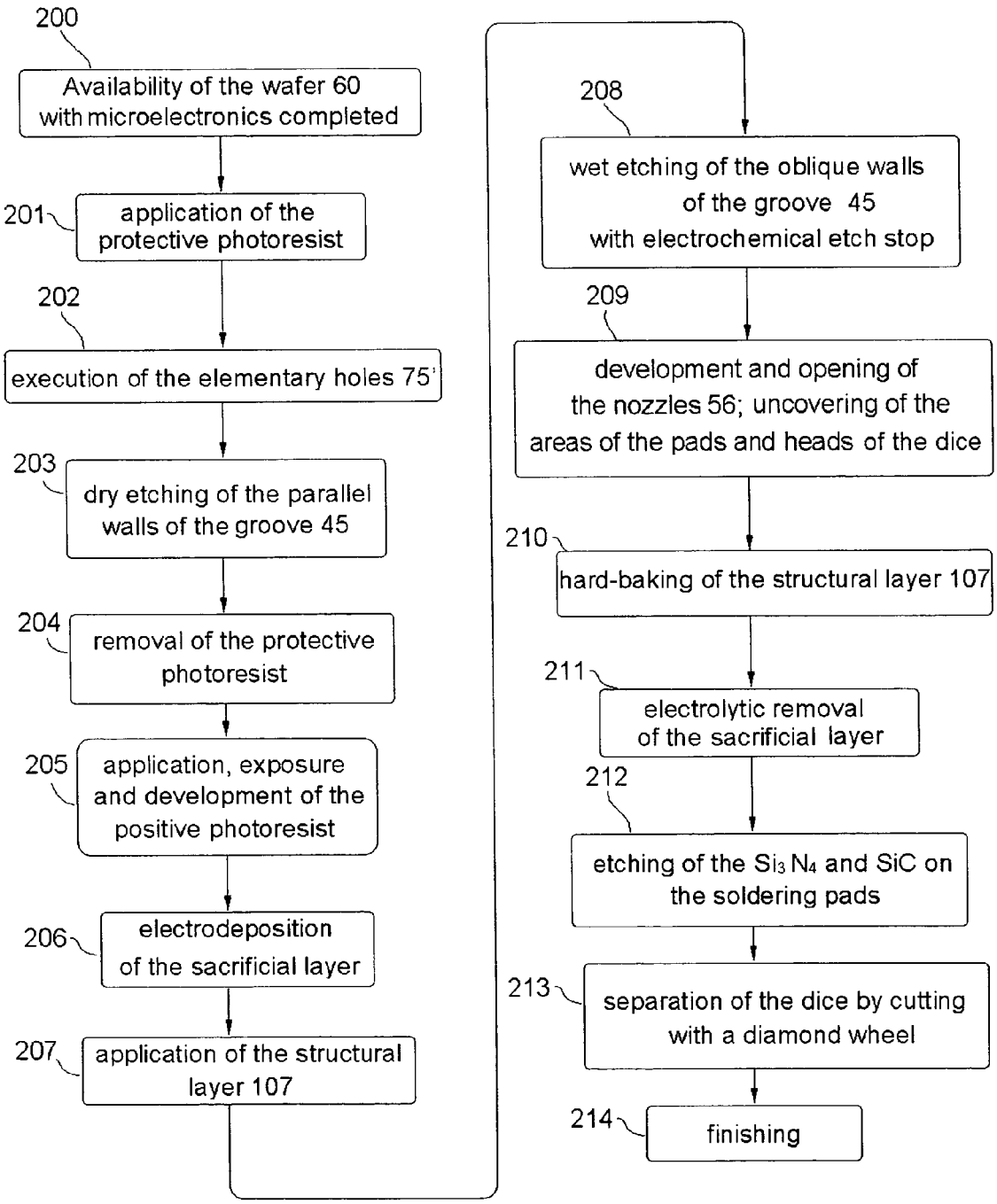
FIG. 13—illustrates the flow of the manufacturing process of the actuating assembly of FIG. 7 and of FIG. 10.

A second embodiment of the manufacturing process consists in carrying out the operations in the order indicated in the flow diagram of FIG. 13. With regard to the production details of the single steps, reference is again made to the above-quoted Italian patent application. The description that follows contains solely the information necessary for an understanding of the innovative aspects of the present embodiment.

In the step 200, a wafer 60 of Silicon is available as it is at the end of the first part of the process, comprising a plurality of dice 61, with their microelectronics 62 completed, protected by the protective layer 30 of $Si_3N_4$ and SiC, on which the conducting layer 26 is deposited, and prepared for the subsequent operations in the areas of microhydraulics 63' adapted for production of the ejectors 73 constituting the microhydraulics 63.

Figure 14:
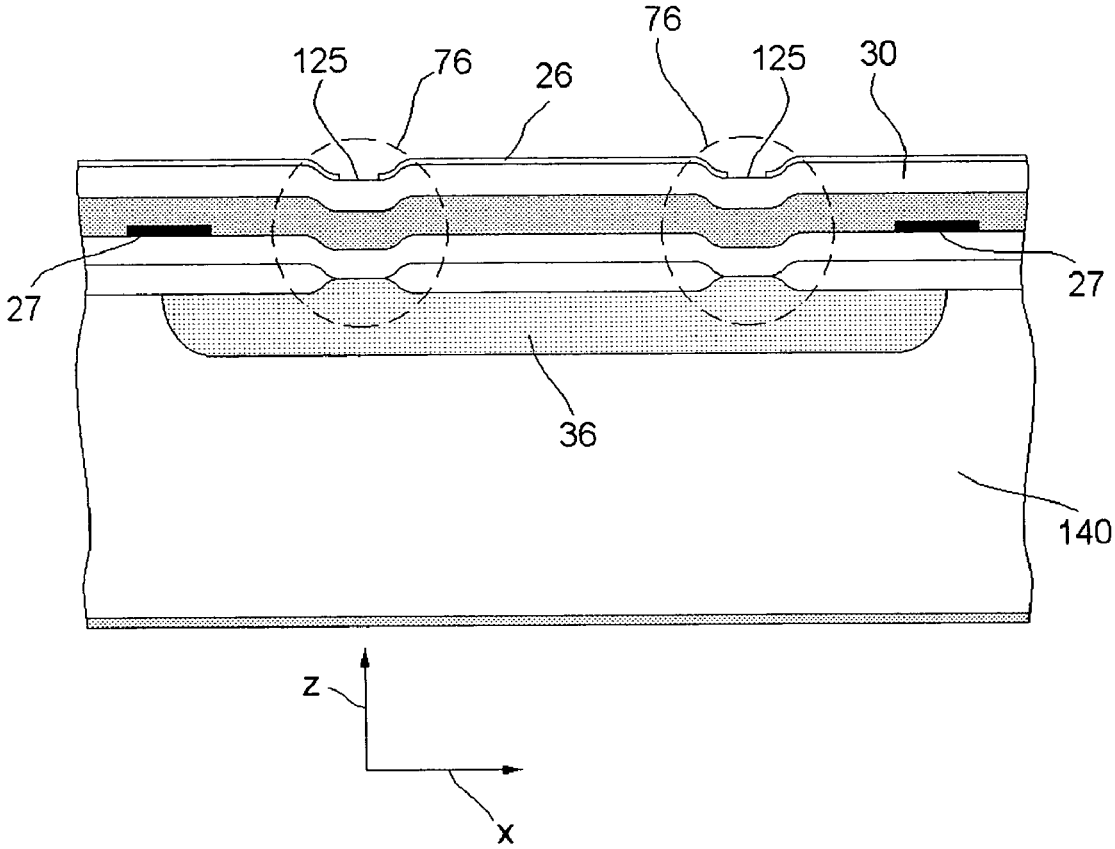
FIG. 14—illustrates a section of the actuating assembly of FIG. 7 and of FIG. 10 at the beginning of the manufacturing process.

FIG. 14 represents an area of the head intended for containing the ejectors 73, as it appears in this step. Indicated in the figure are the substrate 140 of Silicon P, the protective layer 30 of $Si_3N_4$ and SiC, the conducting layer 26, the N-well layer 36 and regions 76 prepared for a subsequent drilling operation, in correspondence with each of which the conducting layer 26 presents N apertures 125 having the same shape as will be assumed by the envisaged N elementary ducts 75. Only one of the N apertures 125 for each region 76 is depicted in the figure.

Figure 15:
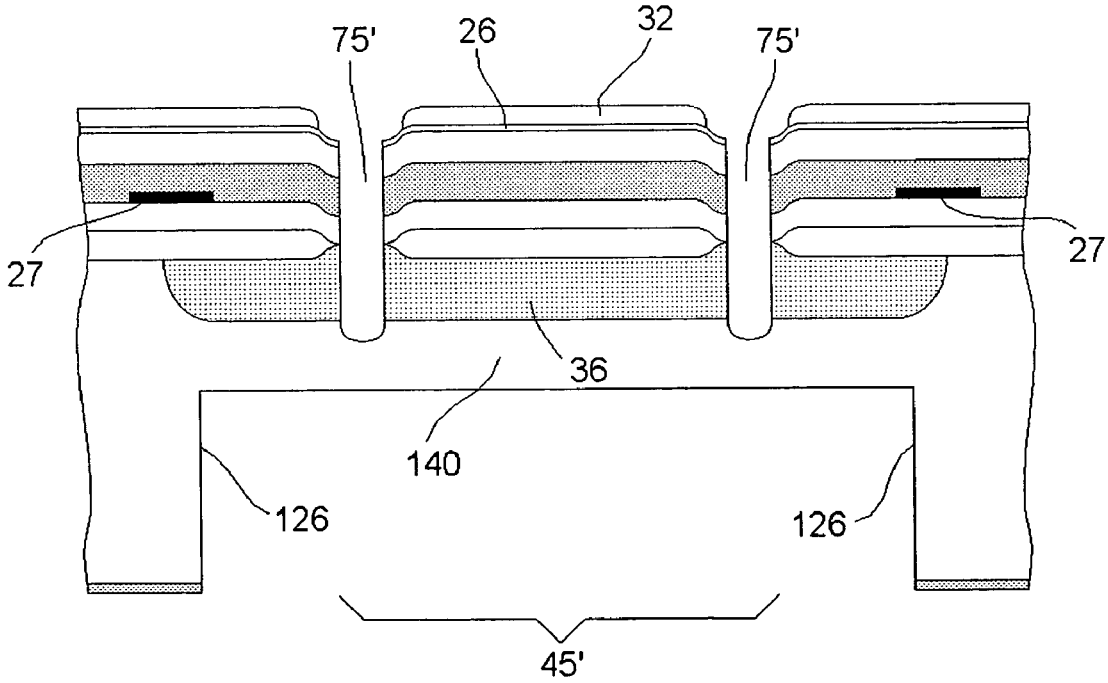
FIG. 15—illustrates a section of the actuating assembly of FIG. 7 and of FIG. 10 in a phase of the manufacturing process.

FIG. 15 shows the area of the ejectors 73, as it will appear at the end of the next steps 201, 202 and 203.

In the step 201, a protective photoresist 32 is applied on the layer 26, in order to protect the entire wafer 60 in the successive operations. Voids are made in the protective photoresist 32 using known techniques, in order to leave the apertures 125 uncovered.

In the step 202, using as the mask the conducting layer 26, elementary holes 75' are made in correspondence with the apertures 125, using for example a "dry" type technology known to those acquainted with the sector art as ICP (Inductively Coupled Plasma). The holes 75' are blind holes and partly enter the substrate 140.

In the step 203, etching of the groove 45 commences, again using ICP technology, for instance. The portion of the groove 45 made in this phase, indicated as 45', has its walls 126 substantially parallel to the plane y-z, and reaches a distance of between, for example, 100 and 150 μm from the N-well 36.

Figure 16:
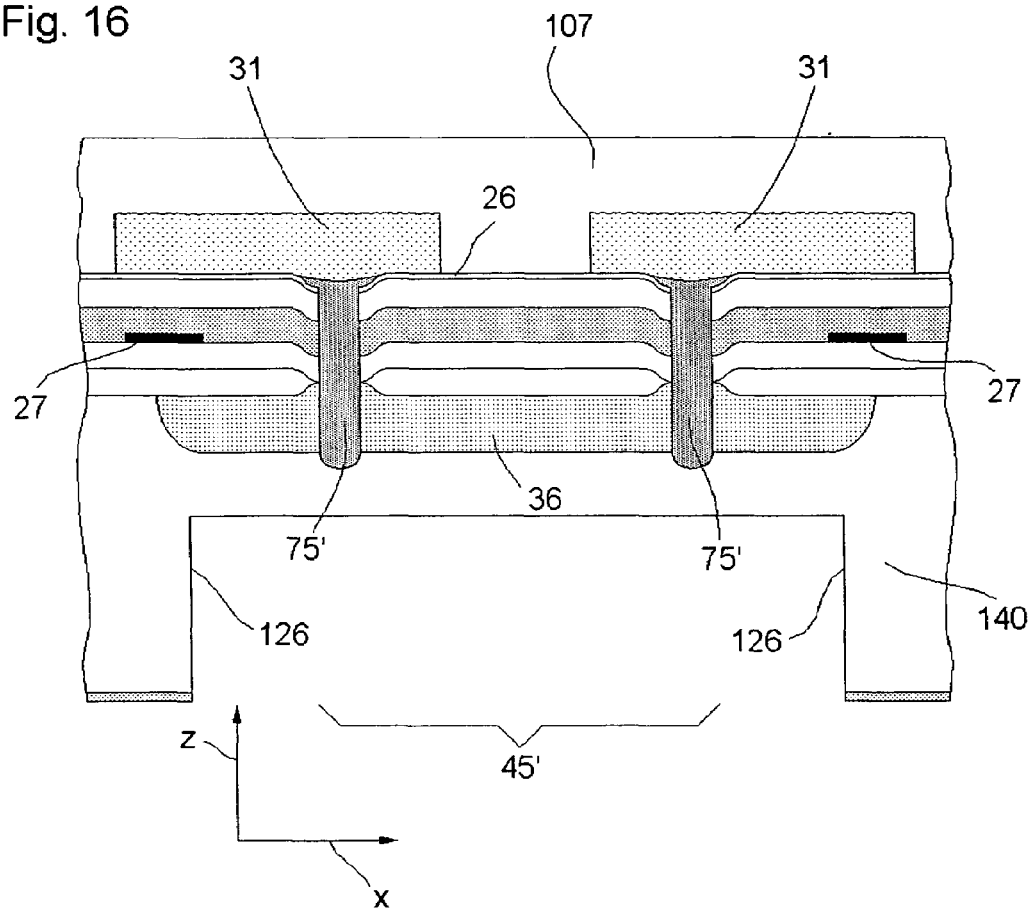
FIG. 16—illustrates a section of the actuating assembly of FIG. 7 and of FIG. 10 in a further phase of the manufacturing process.

Depicted in FIG. 16 is the area of the ejectors 73, as it will appear at the end of the next steps from 204 to 207.

The protected photoresist 32 is removed in step 204.

In the step 205, applied on top of the conducting layer 26 is a positive photoresist having a thickness equal to the height that the chambers 74 will have, using for instance a centrifuge in a process known as spinner coating. The application is performed in such a way that the positive photoresist can also fill the elementary holes 75', by means for instance of reducing the speed of the centrifuge during a first phase of the operation. Using a mask not shown in any of the figures, the photoresist is exposed to ultraviolet radiation only in correspondence with windows having the shape of that section parallel to the plane x-y that the future chambers 74 and future junction channels 68 will have. The intensity of the ultraviolet radiation is regulated in such a way that the positive photoresist is depolymerized only as far as the conducting layer 26, but not inside the elementary holes 75'. Finally development is performed, during which the portion of depolymerized photoresist is removed, which in this way leaves cavities having the shape of the future chambers 74 and the future junction channels 68, whereas the elementary holes 75' continue to be occupied by the positive photoresist, indicated by the shading, which has remained polymerized as it has not been reached by the ultraviolet radiation.

Carrying out the operations in the order indicated by this second embodiment of the manufacturing process gives the advantage of effecting this step while the groove 45' and the holes 75' are not in communication, being separated by a layer of Silicon having a thickness of between, for example, 100 and 150 μm, and there is therefore no need to fill the groove with a temporary layer to protect the area in which the positive photoresist is developed.

In the step 206, electrodeposition of a metal, for instance Copper, Gold, or Nickel, is performed inside the cavities made in the step 203, in such a way as to form the sacrificial layers 31, having the shape of the future chambers 74 and future junction channels 68.

In the step 207, on the upper face 170 that contains the sacrificial layers 31, the structural layer 107 is applied of thickness preferably between 15 and 60 μm and consisting of an epoxy or polyamide type negative photoresist, which is partially polymerized, or consisting of an epoxy resin selectively deposited on the area 63' intended to accommodate the ejectors 73.

Figure 17:
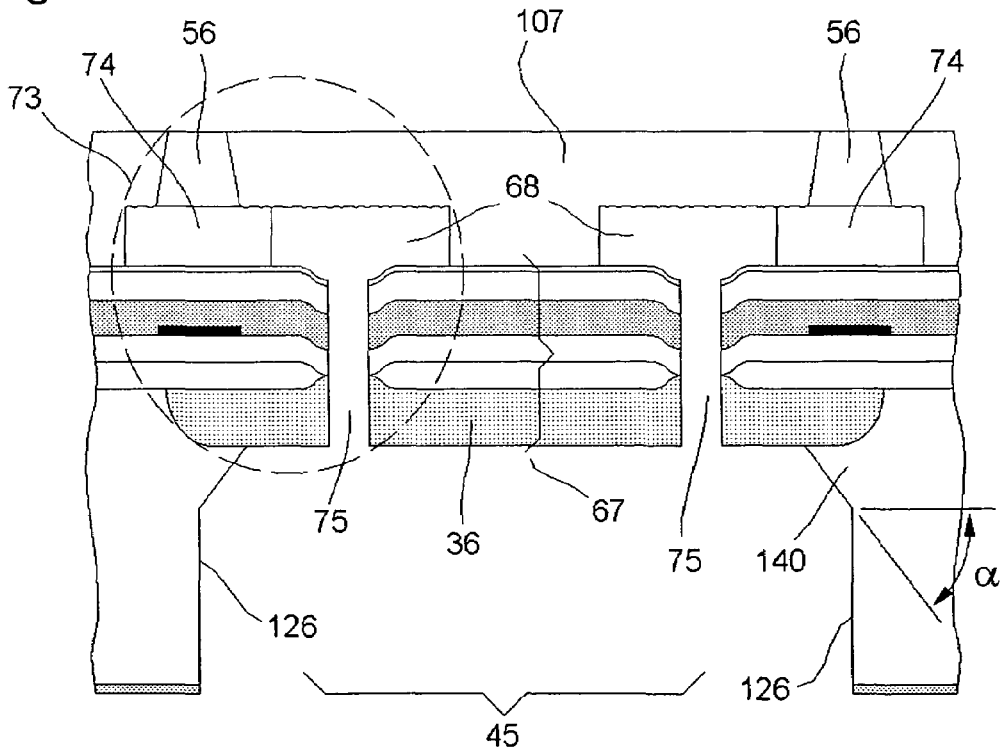
FIG. 17—illustrates a section of the actuating assembly of FIG. 7 and of FIG. 10 at the end of the manufacturing process.

FIG. 17 depicts the area of the ejectors 73, as it will appear at the end of the next steps, from 208 to 213.

In the step 208, etching of the groove 45 is completed by means of a "wet" technology, using, for example, a KOH (Potassium Hydroxide) or TMAH (Tetrametil Ammonium hydroxide) bath, as is known to those acquainted with the sector art. Etching of the groove 45 is conducted according to geometric planes defined by the crystallographic axes of the Silicon, and accordingly forms an angle $\alpha$=54.7°. The etching is stopped automatically when the N-well layer 36 is reached by way of a method, called "electrochemical etch stop" and known to those acquainted with the sector art. Following this operation, the groove 45 remains bounded by the lamina 67, and the holes 75' are through holes, their blind bottom having been removed.

In the step 209, the nozzles 56 are opened in the structural layer 107 by means, for instance of a laser drilling, the holes 75' are freed of the positive photoresist, thereby producing the elementary ducts 75, and the areas corresponding to the soldering pads 77 and the die heads, not depicted in the figures, are freed of the negative photoresist.

In the step 210, hard baking of the structural layer 107 is effected, for the purpose of obtaining its complete polymerization.

In the step 211, the sacrificial layer is removed by means of an electrolytic process. The cavities left empty by the sacrificial layer in this way come to form the chambers 74 and the junction channels 68.

The technology described from step 205 to step 211 is known to those acquainted with the sector art, being that used to produce MEMS/3D (MEMS: Micro Electro Mechanical System).

In the step 212, etching is performed of the protective layer 30 of $Si_3N_4$ and of SiC in correspondence with the soldering pads.

In the step 213, the wafer 60 is cut into the individual die 61 using a diamond wheel, not shown in any of the figures.

Finally, in step 214, the following operations, again known to those acquainted with the sector art, are performed:

soldering of a flat cable on the die 61 using the TAB (Tape Automatic Bonding) process, in order to form a subgroup;

assembling the subgroup on the container of the head 40;

filling of the ink 142;

testing of the finished head 40.

The step 206, electrodeposition of the sacrificial layer 31; the step 208, wet etching of the oblique walls of the groove 45 with an electrochemical etch stop; and the step 211, electrolytic removal of the sacrificial layer 31, require operations performed by means of electrochemical processes, during which specific layers belonging to all the dice 61 of the wafer 60 and, where applicable, all the segments into which the dice 61 are subdivided must be put at the same electrical potential.

This may be done advantageously as described in the Italian patent application TO 99A 000987, which is incorporated herein.

The invention claimed is:

1. Manufacturing process for a thermal ink jet printhead comprising a tank suitable for containing ink, a groove in fluid connection with said tank, a lamina and chambers, comprising the step of:

disposing of a wafer containing a plurality of dice, each of which contains a substrate, a plurality of resistors, and a conducting layer, said dice having an upper face and a lower face, wherein said process also comprises the steps of:

applying a protective photoresist on top of the conducting layer;

making a plurality of elementary holes through said lamina, each of said elementary holes being in correspondence with one of said resistors;

etching a first part of said groove in said substrate on said lower face of each of said dice;

removing said protective photoresist;

applying a layer of positive photoresist on said upper face of each of said dice, and producing, through exposure and development operations, a plurality of cavities, each of said cavities being in correspondence with each of said resistors and being shaped so as to cover the corresponding resistor and at least one plurality of said elementary holes;

depositing a plurality of sacrificial layers inside each of said cavities;

applying a structural layer on top of said upper face of each of said dice and on top of said sacrificial layers;

etching a second part of said groove in said substrate on said lower face of each of said dice, until said elementary holes are reached and rendered pass-through;

making a plurality of nozzles on said structural layer, each of said nozzles being in correspondence with one of said sacrificial layers;

hard-baking said structural layer;

removing said sacrificial layers.

2. Process according to claim 1, wherein said steps of depositing a plurality of sacrificial layers on each of said dice; etching a second part of said groove; and removing said plurality of sacrificial layers on each of said dice are performed using electrochemical processes.

3. Process according to claim 2, wherein said steps of depositing a plurality of sacrificial layers on each of said dice; etching a second part of said groove; and removing said plurality of sacrificial layers from each of said dice use as the electrode said conducting layer, said conducting layer forming a single network connected on the inside of each of said dice.

4. Process according to claim 3, wherein said conducting layer forms a single network connected between at least two different ones of said dice.

5. Process according to claim 3, wherein said conducting layer forms a single network connected between all said dice belonging to said wafer.

* * * * *